US006286229B1

(12) United States Patent
Simolin et al.

(10) Patent No.: US 6,286,229 B1
(45) Date of Patent: Sep. 11, 2001

(54) METHOD AND APPARATUS FOR TREATING A BOARD-LIKE MATERIAL WITH A GASEOUS AGENT

(75) Inventors: Kari Simolin, Lahti; Erno Tulonen, Kalliola, both of (FI)

(73) Assignee: Valmet Panelhandling Oy, Nastola (FI)

( * ) Notice: Subject to any disclaimer, the term of this patent is extended or adjusted under 35 U.S.C. 154(b) by 0 days.

(21) Appl. No.: 09/423,053

(22) PCT Filed: Apr. 30, 1998

(86) PCT No.: PCT/FI98/00375

§ 371 Date: Jan. 10, 2000

§ 102(e) Date: Jan. 10, 2000

(87) PCT Pub. No.: WO98/50208

PCT Pub. Date: Nov. 12, 1998

(30) Foreign Application Priority Data

May 2, 1997 (FI) ..... 971899

(51) Int. Cl.[7] ..... F26B 7/00

(52) U.S. Cl. ..... 34/394; 34/394; 34/396; 34/417; 34/422; 34/430; 34/495; 34/548; 34/589; 34/634; 34/636; 34/649

(58) Field of Search ..... 34/381, 391, 393, 34/394, 396, 402, 417, 422, 430, 495, 548, 569, 589, 86, 623, 629, 634, 636, 649, 242

(56) References Cited

U.S. PATENT DOCUMENTS 3,267,585 * 8/1966 Futer ..... 34/430
4,146,973 * 4/1979 Steffensen et al. ..... 34/41
4,154,004 * 5/1979 Trötscher ..... 34/159
4,215,489 * 8/1980 McMahon, Jr. ..... 34/242
4,255,102 3/1981 Smedberg et al. .
4,439,930 * 4/1984 McMahon, Jr. ..... 34/242 X
5,564,200 * 10/1996 Strahm ..... 34/636
5,579,590 * 12/1996 Seidl et al. ..... 34/636
6,101,739 * 8/2000 Rutz et al. ..... 34/373

FOREIGN PATENT DOCUMENTS 69269 1/1986 (FI) .
1598852 9/1981 (GB) .
186400 11/1963 (SE) .

* cited by examiner

*Primary Examiner*—Stephen Gravini

(57) ABSTRACT

The present invention provides a method of treating board-like material with a gaseous treatment agent and an apparatus for implementing the method. According to the method, a gaseous treatment agent is passed through the board-like material being treated. The board-like material is introduced into at least one treatment zone, where the gaseous treatment agent is contacted with at least one side of the board-like material and is caused to pass through the thickness of the material. The properties of the gaseous treatment agent, including its temperature, moisture content and/or composition, are controlled as needed in order to achieve a desired effect on the board-like material being treated. The apparatus includes a chamber and a support for the board-like material in the chamber. When positioned in the chamber, the board-like material forms at least part of a partition separating the chamber into two regions. The gaseous treatment agent is introduced through nozzles into the first region, where it contacts one side of the board-like material. The other side of the board-like material is subjected to a vacuum created in the second region of the chamber. The pressure differential between the two regions of the chamber causes the gaseous treatment agent to pass through the thickness of the board-like material.

15 Claims, 2 Drawing Sheets

METHOD AND APPARATUS FOR TREATING A BOARD-LIKE MATERIAL WITH A GASEOUS AGENT

This application is the national phase under 35 U.S.C. § 371 of PCT International Application No. PCT/FI98/00375 which has an International filing date of Apr. 30, 1998, which designated the United States of America.

The present invention relates to a method according to the preamble of claim 1. The invention further concerns an apparatus according to claim 11.

In the manufacture of planar materials such as wood-based boards, it is necessary to cool the boards exiting from the press, prior to their further processing. Today, the cooling is performed in a board turner/cooler also called a cooling wheel, which is a massive rotary unit having a diameter of 7 m typical comprised of radial slots into which the cut boards are inserted. In the turner, each board can cool freely from both sides during one revolution of the turner, for instance. The capacity of cooling turners is often a bottleneck limiting the production speed or board length in continuously operating board manufacturing lines. The cooling capacity of conventional coolers cannot be varied during operation. Also the emission of obnoxious VOC gases, that is volatile organic carbon compounds has been freely admitted to the ambient air.

It is an object of the present invention to provide a novel method and apparatus capable of overcoming the disadvantages of prior-art techniques.

More specifically, the invention is characterized by what is stated in the appended claims.

The arrangement according to the invention has a number of significant benefits. Particularly, the cooling time of the board material being processed can be shortened essentially. The properties of the board may also be affected during the treatment process. The cooling process of the board can be controlled more accurately and the obnoxious VOC emissions can be confined into a closed space. Moreover, the method may be applied prior to the cutting of the board blank into separate board products.

Figure 1:
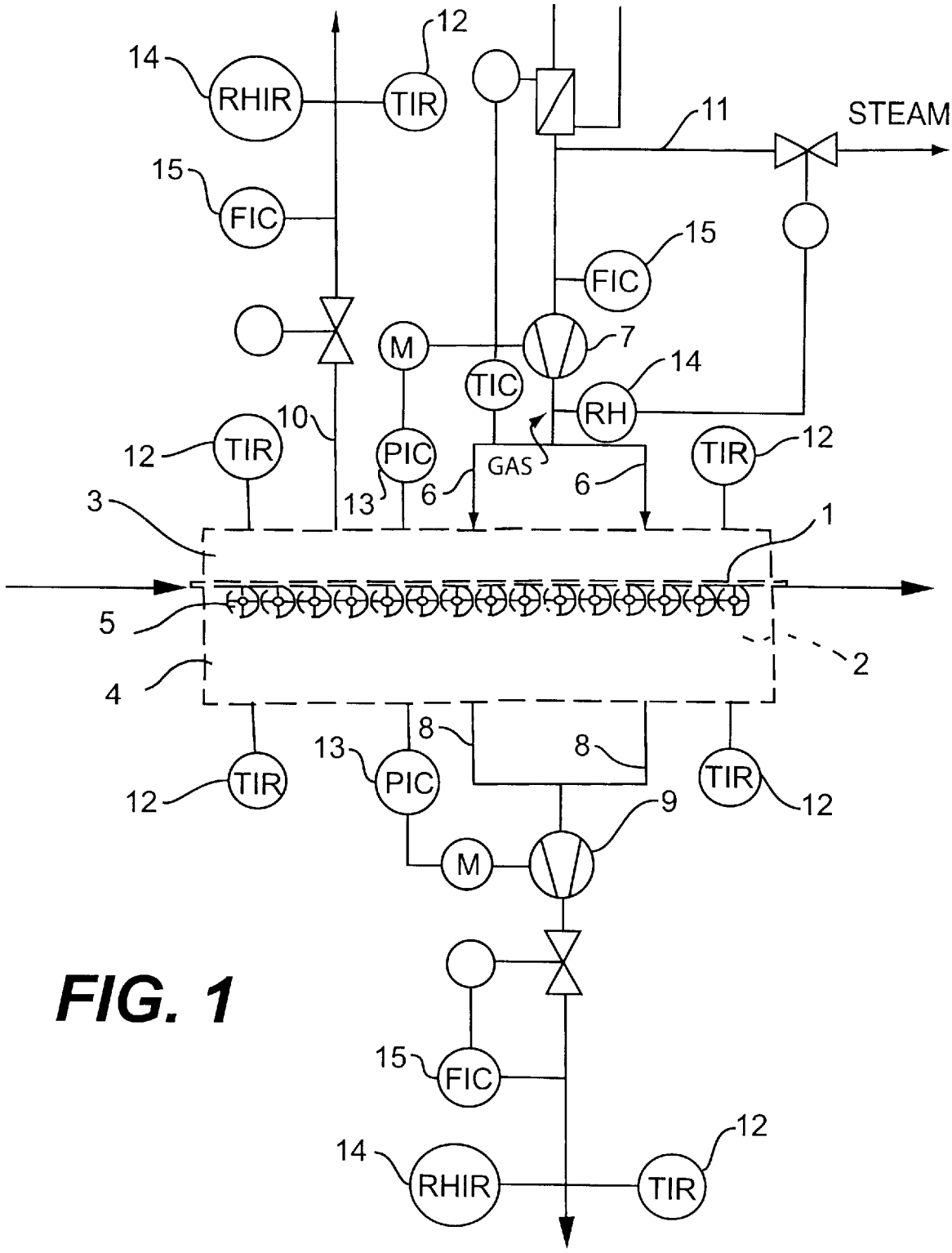
Figure 2:
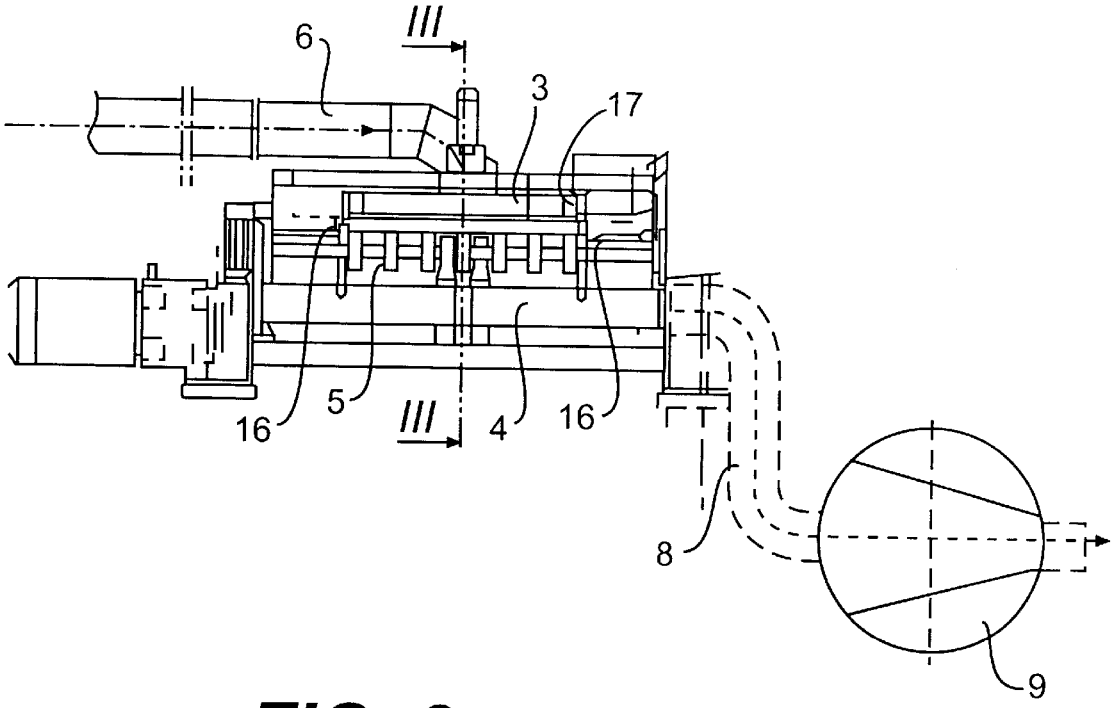
Figure 3:
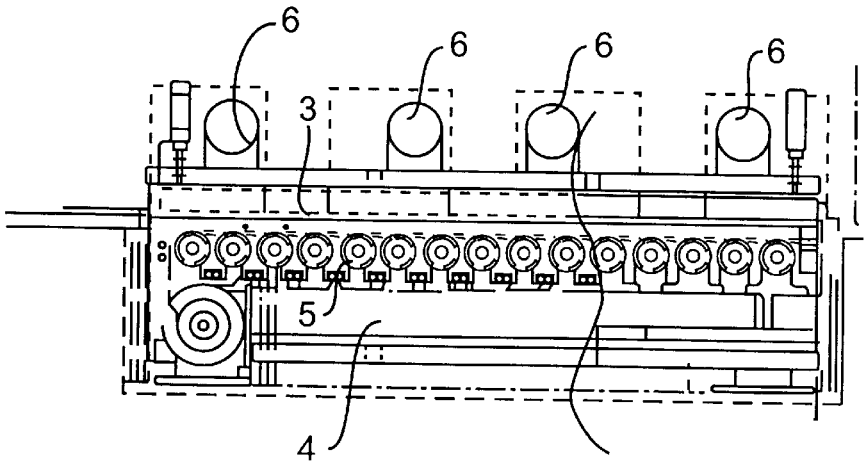

In the following, the invention will be examined in more detail with the help of an example by making reference to the attached drawings in which FIG. 1 shows schematically a simplified cooler arrangement according to the invention;

FIG. 2 shows-an apparatus according to the invention in a partially sectioned end view illustrating the travel of board material therein; and FIG. 3 shows an apparatus according to the invention in a side view partially sectioned along line III—III of FIG. 2.

The method is suited for treating a board-like material with a gaseous agent, whereby the method is implemented as illustrated in the drawings by passing a gaseous agent through the material 1 being treated. The method is based on the concept that the board material 1 being treated is taken into at least one treatment zone 2, where the gaseous treatment agent is contacted with at least one wall of the board and caused to pass through the thickness of the board material 1 and that, if required, the state of the gaseous treatment agent including its temperature, moisture content and/or composition is/are controlled in order to achieve a desired effect on the material 1 being treated.

In the method, the material 1 being treated is moved through at least one treatment zone 2. The material being treated is moved continuously or cyclically through at least one treatment zone.

In FIG. 1 is shown diagrammatically an arrangement suitable for implementing the method. Therein the board-like material 1 such as a pressed wood-based particle board blank is moved by means of a gas-transmissive conveyor 5 to a treatment zone 2. The treatment zone 2 is divided into two compartments 3, 4 separated by the board material 1 to be treated. To the first compartment 3 of the treatment zone (in the diagram located principally above the board material), the gaseous agent is introduced via at least one nozzle 6, wherefrom at least a portion of the gas is directed to pass through the board material 1 into the second compartment 4 of the treatment zone that is situated on the opposite side of the board material. The passage of the gaseous agent from first compartment through the board material to the opposed second compartment is chiefly attributable to the pressure difference which is provided between the separate compartments formed on the opposite sides of the board material. In the arrangement shown in the diagrams, the pressure difference is achieved by forming a vacuum to the underside of the board material with the help of at least one suction pump means 9 such as a rotary vacuum pump. The opposite side of the board material is provided with means 6, 7 for introducing the gaseous agent into the first compartment 3 of the treatment zone. Preferably, the first compartment of the treatment zone is also equipped with means 10 for discharging a portion, typically the excess portion, of the gaseous agent away from the treatment zone. By altering the state of the gaseous treatment agent including its composition, temperature, moisture content and the pressure difference between the treatment zone compartments surrounding the two sides of the board material, it is possible to exert a desired treatment effect on the board material. In the arrangement of FIG. 1, the gas inlet nozzle 6 is provided with a nozzle 11 serving, e.g., to introduce steam into the flow of the gaseous treatment agent.

The second compartment of the treatment zone is provided with means 8, 9 for discharging the gaseous treatment agent from the second compartment of the treatment zone. The discharged gas can be recycled back to the treatment process according to the invention, or alternatively, passed to postprocessing such as gas scrubbing or incineration.

All gas-transmissive board-like materials are suited for treatment in the method according to the invention. Obviously, the treatment process parameters such as the required pressure difference are affected by the qualities of the board material to be treated and the desired treatment effect. Typical board materials to be treated include different kinds of wood-based particle boards such as MDF boards, flake boards, fiber boards, OSB boards and others. For certain board materials, the required pressure difference may be in the order of 20 kPA when the board thickness is, e.g., 30 mm. Then, the volumetric gas flow through the board is about 0.1 $m^3/s$, while for a 4 mm board the gas flow is about 0.4 $m^3/s$.

An advantageous implementation of the method according to the invention is to affect the temperature of the board material via the treatment according to the method. Principally, this goal is achieved by cooling the board material by directing onto the board material a gas flow of lower temperature than that of the board material. The cooling process can be complemented with other treatment effects through varying the moisture content of the treatment gas, for instance. In this manner, the properties of the board material such as its VOC content, moisture and temperature can be affected, or alternatively, it is possible to introduce chemicals into the board, for instance. The cooling effect can be controlled by altering the temperature and moisture content of the treatment gas.

Furthermore, it is possible to use a plurality of the treatment zones 2, arranged in series and/or parallel, whereby each treatment zone can be used separately for affecting the properties of the board material via individually adjusted treatment gas compositions, temperature, moisture content or other parameters and/or pressure differences and volumetric flow rates. In an arrangement comprising a plurality of treatment zones, it is advantageous to pass the gaseous agent in at least one treatment zone through the material being treated so that the pass-through flow direction is essentially opposite to that used in the adjacent zone.

In a preferred embodiment, at least a portion of the gas used in the preceding treatment zones is passed on to the next treatment zone, and so forth. For instance, one practical arrangement of the zones is such that the treatment gas is first introduced into the last zone of the cooling line and therefrom successively through the zones countercurrent to the board travel direction until reaching the first zone of the cooling line, whereby an optimally graded cooling effect on the board is attained.

In a preferred embodiment, the heat of the treatment gas is recovered after the gas has been passed through the board material. The heat recovery may be implemented using, e.g., a heat exchanger placed on a pipe 8 shown in FIG. 1, or alternatively, in a chamber 4, for instance. The recovered heat can be utilized in a conventional manner, e.g., for the heating of a building.

Advantageously, the treatment zone is complemented with sensor devices such as pressure sensors 13, temperature sensors 12, moisture content sensors 14 and/or flow rate sensors 15, whose output signals are utilized in the control of the treatment process. In the arrangement of FIG. 1, the temperature sensors are placed into the treatment zone at the entry end and the exit end of the board material into and away from treatment zone, respectively, whereby it is possible to monitor, e.g., the change of temperature drop in the cooling zone and to control the cooling rate of the board material, for instance.

An apparatus suited for implementing the method comprises a chamber space 2 including a first compartment 3 and means 6, 7 for passing a gaseous treatment agent into said first compartment, a second compartment 4 and means 8, 9 for forming a vacuum into said second compartment of the chamber space, and further means 5, 16 for supporting the board-like material in the chamber space, whereby the board-like material 1 under treatment itself forms at least a portion of the wall separating the first compartment from the second compartment of said chamber space. The apparatus is further characterized in that it is equipped with sensor elements 12, 13, 14, 15 for monitoring the status of the material 1 being treated and/or of the gaseous treatment agent, that the apparatus is controlled as required on the basis of sensor element output signals and that the apparatus includes means for controlling the state parameters of the gaseous treatment gas including its temperature, moisture content and/or composition.

Accordingly, the apparatus needs means for conveying the board material within the treatment zone. Such a means may be, e.g., a roller conveyor 5 similar to the one shown in FIGS. 2 and 3, or any other type of conveyor permitting free passage of gas through its structure. The conveyor 5 or its immediate vicinity is provided with sealing means 16 adapted to seal against the surface of the board 1, whereby the board material can form a portion of the intercompartmental wall which separates the at least one first compartment 3 from the at least one second compartment 4 of the treatment zone.

Advantageously, the seal means 16 are adapted to form a sealing perimeter which is in intimate contact with the surface of the board material. Advantageously, the apparatus also includes a second seal means 17 adapted above the board material as shown in FIG. 2. Advantageously, the seal means 17 forms a sealing perimeter and is lower-able onto the surface of the board material. The seal means 17 serves to enclose the gaseous emissions evaporating from the top surface of the board material into a closed space, thus preventing the emissions from escaping into the ambient air. Thence, the treatment zone is advantageously designed into a closed construction, whereby the treatment gas and the obnoxious emissions possibly evaporating from the board are effectively collected and passed to further processing or incineration, for instance.

The apparatus may also be complemented with a heat-recovering means such as a heat exchanger, whereby the heat transferred from the board material into the gas can be utilized in some other process such as heating of buildings, for instance.

To those versed in the art it is obvious that the invention is not limited by the exemplifying embodiments described above, but rather, can be varied within the scope and spirit of the appended claims.

What is claimed is:

1. A method for treating a board-like material with a gaseous treatment agent, the method comprising the steps of:

a) introducing the board-like material into at least one treatment zone;

b) contacting at least one side of the board-like material with the gaseous treatment agent in the at least one treatment zone;

c) causing the gaseous treatment agent to pass through the thickness of the board-like material in the at least one treatment zone; and d) using the gaseous treatment agent to effect a change in the temperature of the board-like material in the at least one treatment zone.

2. The method as defined in claim 1, wherein the gaseous treatment agent effects a heating of the board-like material.

3. The method as defined in claim 1, wherein the gaseous treatment agent effects a cooling of the board-like material.

4. The method as defined in claim 1, and further comprising the step of moving the board-like material through the at least one treatment zone.

5. The method as defined in claim 4, wherein the board-like material is moved continuously through the at least one treatment zone.

6. The method as defined in claim 4, wherein the board-like material is moved cyclically through the at least one treatment zone.

7. The method as defined in claim 1, wherein the board-like material is introduced into a plurality of treatment zones, and wherein:

in at least one of the plurality of treatment zones, the treatment agent contacts a first side of the board-like material and passes through the thickness of the board-like material in a direction from the first side to a second side of the board-like material; and in a treatment zone following the at least one of the plurality of treatment zones, the treatment agent contacts a first side of the board-like material and passes through the thickness of the board-like material in a direction from the second side to the first side of the board-like material.

8. The method as defined in claim 7, and further comprising the step of moving the board-like material through the plurality of treatment zones.

9. The method as defined in claim 8, wherein the board-like material is moved continuously through the plurality of treatment zones.

10. The method as defined in claim 8, wherein the board-like material is moved cyclically through the plurality of treatment zones.

11. The method as defined in claim 1, and further comprising the following steps:

collecting obnoxious emissions released by the board-like material in the at least one treatment zone; and conducting the emissions away from the at least one treatment zone to a facility where the emissions can be subjected to further processing.

12. The method as defined in claim 1, and further comprising the step of conducting the gaseous treatment agent, following its passage through the board-like material, to a heat exchanger, to thereby enable utilization of the residual heat of the gaseous treatment agent after its employment in treating the board-like material.

13. The method as defined in claim 1, and further comprising the step of controlling the temperature of the gaseous treatment agent to thereby achieve favorable properties in the treated board-like material.

14. The method as defined in claim 1, and further comprising the step of controlling the moisture content of the gaseous treatment agent to thereby achieve favorable properties in the treated board-like material.

15. The method as defined in claim 1, and further comprising the step of controlling the composition of the gaseous treatment agent to thereby achieve favorable properties in the treated board-like material.

* * * * *